US006668702B2

(12) United States Patent
Sud et al.

(10) Patent No.: US 6,668,702 B2
(45) Date of Patent: Dec. 30, 2003

(54) METHOD AN APPARATUS FOR PRODUCING HIGH PRESSURE COMPRESSOR CYLINDER LINERS

(75) Inventors: Lavlesh Sud, Farmington Hills, MI (US); Vipen Khetarpal, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 101 days.

(21) Appl. No.: 09/976,749

(22) Filed: Oct. 12, 2001

(65) Prior Publication Data

US 2003/0070543 A1 Apr. 17, 2003

(51) Int. Cl.[7] ..... F01B 11/02
(52) U.S. Cl. ..... 92/171.1
(58) Field of Search ..... 92/171.1

(56) References Cited

U.S. PATENT DOCUMENTS

| | | | | |
|---|---|---|---|---|
| 2,125,434 A | | 8/1938 | Eplett | |
| 2,204,626 A | | 6/1940 | Scott | |
| 3,396,711 A | * | 8/1968 | Fangman et al. | |
| 3,439,586 A | | 4/1969 | Hottan | |
| 4,016,850 A | * | 4/1977 | Bloemers | 92/171.1 |
| 4,379,425 A | | 4/1983 | Ishizuka | |
| 4,613,018 A | * | 9/1986 | Weiler et al. | 92/171.1 |
| 5,189,943 A | * | 3/1993 | Powers | |
| 5,497,693 A | * | 3/1996 | Ward | 92/171.1 |
| 6,123,052 A | * | 9/2000 | Jahn | |
| 6,267,569 B1 | * | 7/2001 | Alaze | 92/171.1 |

FOREIGN PATENT DOCUMENTS

| | | | |
|---|---|---|---|
| GB | 2021236 A | * 11/1979 | F16J/11/04 |
| JP | 56-14658 | 2/1981 | |

* cited by examiner

*Primary Examiner*—Edward K. Look
*Assistant Examiner*—Igor Kershteyn
(74) *Attorney, Agent, or Firm*—Brinks Hofer Gilson & Lione

(57) ABSTRACT

A cylinder liner system comprising a cylinder liner having an elongated tube, an inside surface, an outside surface, and a notch on a top side; a block having a bore for concentrically accepting the cylinder liner and a locking pin that engages the cylinder liner and the block.

32 Claims, 2 Drawing Sheets

METHOD AN APPARATUS FOR PRODUCING HIGH PRESSURE COMPRESSOR CYLINDER LINERS

BACKGROUND OF THE INVENTION

The present invention relates to cylinder liners. More specifically, the present invention relates to improved cylinder liners used in high-pressure compressors that use $CO_2$ as a refrigerant.

DISCUSSION OF RELATED ART

The prior art does not teach the use of cylinder liners having a locking pin to prevent rotation within a high-pressure small diameter bore. In a large part, the prior art discloses the use of cylinder liners in internal combustion engines.

In high-pressure small diameter bores, there is excessive side loading. Conventional light-weight aluminum alloys cannot withstand these pressures. This requires the use of special material liners and a method or apparatus to lock these liners in place so that the expansion differential between the cylinder block and the cylinder liner does not cause movement of the liner within the bore.

BRIEF SUMMARY OF THE INVENTION

One embodiment of the present invention regards a cylinder liner system comprising a cylinder liner, a block and a locking pin. The cylinder liner is an elongated tube having an inside surface, an outside surface and a notch on the top. The block has a bore for concentrically accepting the cylinder liner. The locking pin engages the block and cylinder liner.

Another embodiment of the present invention regards a cylinder liner system comprising an annular flange having a cylinder liner member and a block. The cylinder liner member is comprised of an elongated tube extending in the axial direction from the bottom surface of the annular flange, an inside surface and a smooth outside surface. The block has a bore in it for concentrically accepting the annular flange and the cylinder liner member. The bore also has a seating surface for the annular flange.

Another embodiment of the present invention regards a method of producing a high-pressure compressor cylinder liner by providing a cylinder liner having an elongated tube, an inside surface and a cylinder liner notch on the top side, providing a cylinder block having a bore in it for concentrically accepting the cylinder liner, and providing a locking pin that engages the cylinder liner and the cylinder block.

Another embodiment of the present invention regards another method of producing a high-pressure compressor cylinder liner by providing an annular flange having a top surface, a bottom surface and a cylinder liner member extending in the axial direction from the bottom surface of the annular flange (the cylinder liner member is an elongated tube having an inside surface and a smooth outside surface), providing a cylinder block having a bore in it for concentrically accepting the annular flange and the cylinder liner member, and providing a seating surface for the annular flange in the cylinder bore.

In all of the above embodiments the cylinder liner can have a rough cast or grooved outside surface or have adhesive applied to the outside surface to prevent movement within the cylinder.

Additional embodiments and advantages of the present invention will become apparent from the following description and the appended claims when considered with the accompanying drawing.

DETAILED DESCRIPTION OF THE INVENTION

Figure 1:
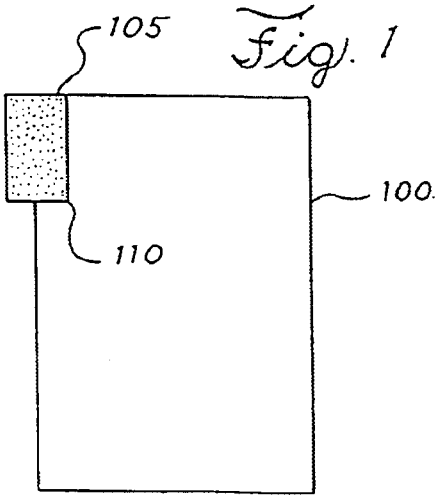
FIG. 1 is a side view of the cylinder liner and locking pin in one embodiment of the present invention.
Figure 2:
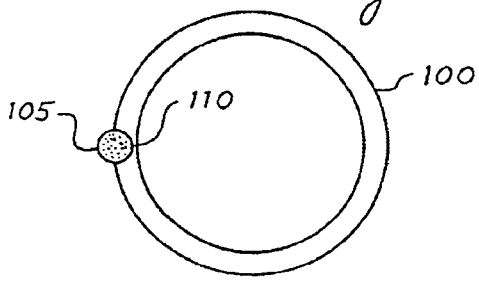
FIG. 2 is a top view of FIG. 1.

As shown in FIG. 1, cylinder liner 100 has a locking pin 105 within the cylinder liner notch 110. FIG. 2 shows a top view of FIG. 1. Typically, the cylinder liner 100 is used as a cylindrical cylinder liner in a high-pressure air conditioning compressor and is inserted into the cylinder bore of a cylinder block (not shown). The cylinder block also has a block notch on its top side extending axially down the inside surface of the cylinder bore, such that, when the block notch and the cylinder liner notch 110 are aligned the locking pin 105 prevents the cylinder liner 100 from rotating within the cylinder block. The top of cylinder liner 100 is flush with the top cylinder block, when cylinder liner 100 is inserted into the bore. The cylinder liner is typically made of high wear resistance and low expansion cast iron. The cylinder block 100 is typically made of aluminum alloy.

The cylinder liner 100 has a diameter greater than the diameter of the cylinder bore resulting in an interference fit when the cylinder liner 100 is placed within the bore. However, an interference fit is not enough to prevent movement within the cylinder bore. Furthermore, excessive interference can distort the thin cylinder liner 100 at lower temperatures. Locking is required because there is a differential expansion between the cylinder liner 100 and the cylinder block. The block has a higher expansion as compared to the cylinder liner 100 and thus without locking, the cylinder liner 100 would be able to move within the cylinder during operation.

To prevent movement in a lateral direction upward, typically, the bore is covered by a valve plate, a gasket or in the case of a compressor, a rear compressor cover.

To prevent movement in a lateral direction downward, typically, the outside surface of cylinder liner 100 further comprises grooves, adhesive or is rough cast. The grooves extend axially along the outside surface of cylinder liner 100 and are typically 0.2 mm deep and equally spaced around the circumference of cylinder liner 100. The use of grooves and rough cast on the outside surface of cylinder liner 100 form complimentary accommodating grooves or rough cast on inside surface of the cylinder bore, thereby preventing downward movement. The adhesive prevents any movement of cylinder liner 100.

Figure 3:
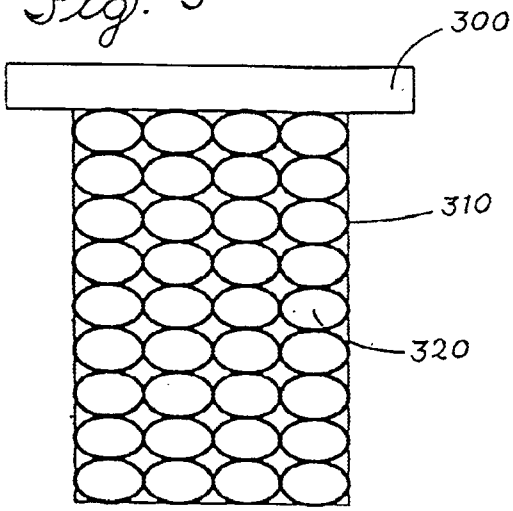
FIG. 3 is a side view of the cylinder liner with a rough outside surface and flange in another embodiment of the present invention.

FIG. 3 shows another embodiment of the present invention. An annular flange 300 has a cylinder liner 310 extending in an axial direction from the bottom of flange 300. The cylinder liner 310 has a rough cast outside surface 320 to prevent rotation within the bore. Typically, the annular flange 300 and the cylinder liner 310 are manufactured as one unit.

Figure 6:
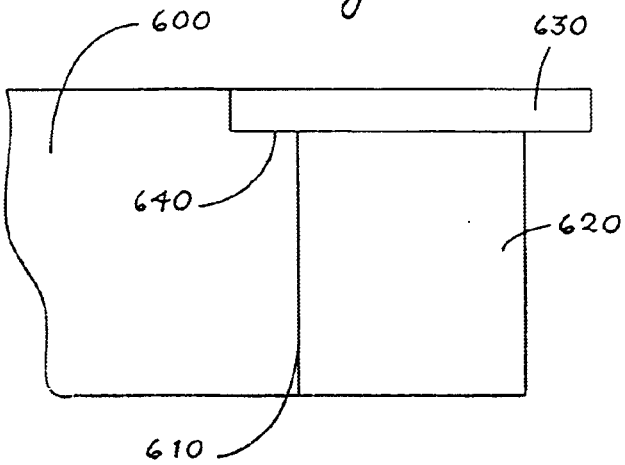
FIG. 6 is a side view of the flange, cylinder liner and cylinder block.

In use, as shown in FIG. 6, a cylinder block 600 has a bore 610 for accepting the cylinder liner 620 and the flange 630. The rough cast outside surface 320 forms a complimentary accommodating surface on the inside surface of bore 610 preventing rotation. To prevent movement in a lateral direction downward, the bore 610 is adapted to present a seating surface 640 for the flange 630. The flange 630 is recessed into the bore 610, such that, the top of the flange 630 is flush with the top of the cylinder block 600. As previously discussed, to prevent movement in a lateral direction upward, typically, the bore is covered by a valve plate, a gasket or in the case of a compressor, a rear compressor cover.

Figure 4:
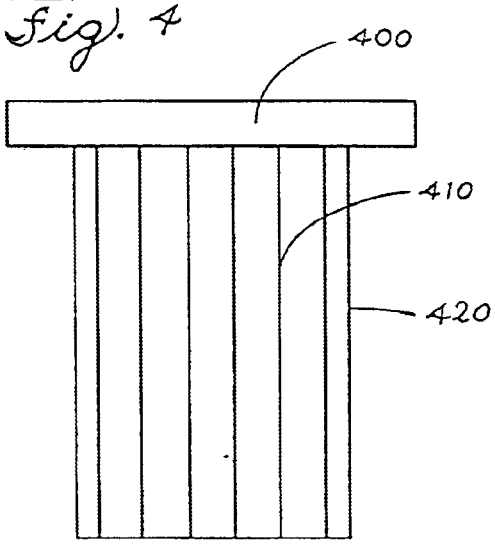
FIG. 4 is a side view of the cylinder liner with a grooved outside surface and flange in another embodiment of the present invention.

FIG. 4 shows another embodiment of the present invention. An annular flange 400 has a cylinder liner 410 extending in an axial direction from the bottom of flange 400. The cylinder liner 410 has vertical grooves 420 on the outside surface of cylinder liner 410 to prevent rotation within the bore. Typically, the annular flange 400 and the cylinder liner 410 are manufactured as one unit. Typically, the grooves 420 are 0.2 mm deep and equally spaced around the cylinder liner 410.

In use, as shown in FIG. 6, a cylinder block 600 has a bore 610 for accepting the cylinder liner 620 and the flange 630. The vertical grooves 420 form a complimentary accommodating surface on the inside surface of bore 610 preventing rotation. To prevent movement in a lateral direction downward, the bore 610 is adapted to present a seating surface 640 for the flange 630. The flange 630 is recessed into the bore 610, such that, the top of the flange 630 is flush with the top of the cylinder block 600. Again, to prevent movement in a lateral direction upward, typically, the bore is covered by a valve plate, a gasket or in the case of a compressor, a rear compressor cover.

Figure 5:
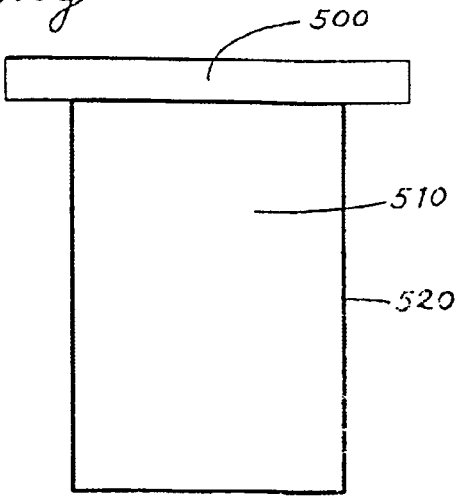
FIG. 5 is a side view of the cylinder liner with a smooth outside surface and flange in another embodiment of the present invention.

FIG. 5 shows another embodiment of the present invention. An annular flange 500 has a cylinder liner 510 extending in an axial direction from the bottom of flange 500. The cylinder liner 510 has adhesive 520 on the outside surface of cylinder liner 510 to prevent rotation within the bore. Typically, the annular flange 500 and the cylinder liner 510 are manufactured as one unit.

In use, as shown in FIG. 6, a cylinder block 600 has a bore 610 for accepting the cylinder liner 620 and the flange 630. The adhesive 520 is applied to the outside surface of the cylinder liner 510 and sticks to the inside surface of bore 610 preventing rotation. To prevent movement in a lateral direction downward, the bore 610 is adapted to present a seating surface 640 for the flange 630. The flange 630 is recessed into the bore 610, such that, the top of the flange 630 is flush with the top of the cylinder block 600. Again, to prevent movement in a lateral direction upward, typically, the bore is covered by a valve plate, a gasket or in the case of a compressor, a rear compressor cover.

Figure 7:
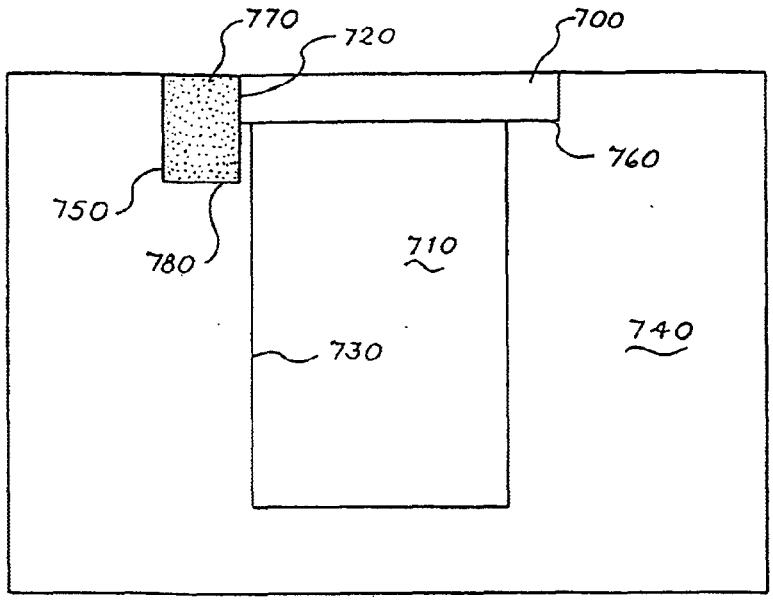
FIG. 7 is a side view of the cylinder liner, flange and locking pin in another embodiment of the present invention.
Figure 8:
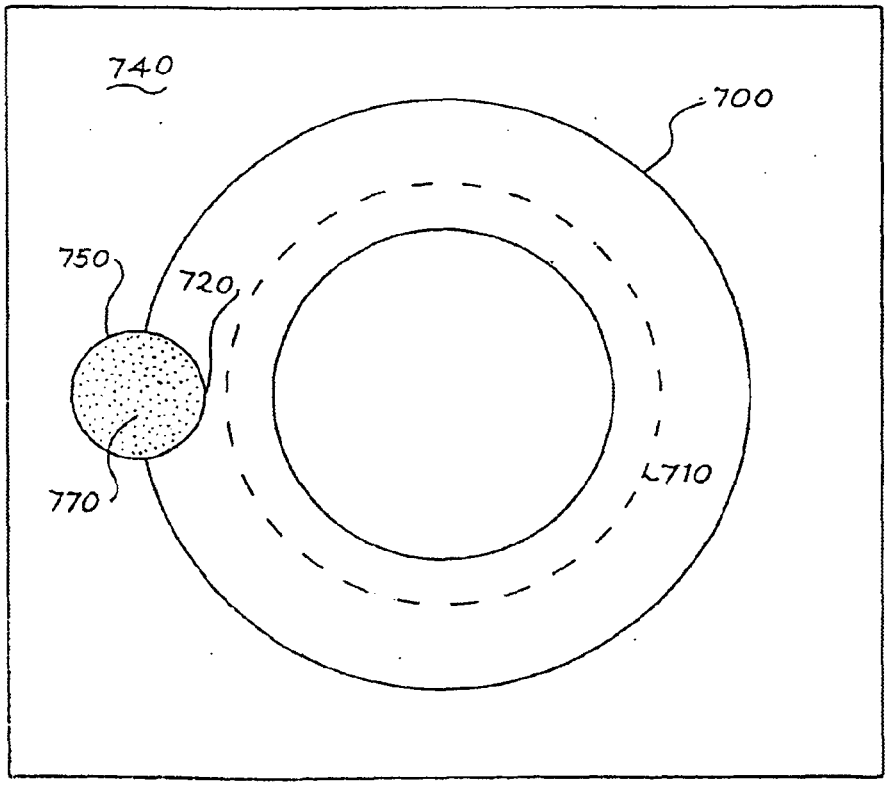
FIG. 8 is a top view of FIG. 7.

FIGS. 7 and 8 show a preferred embodiment of the present invention. An annular flange 700 has a cylinder liner 710 extending in an axial direction from the bottom of flange 700. The flange 700 has a notch 720 extending in an axial direction from the top of the flange along the inside surface of the bore 730. In use, a cylinder block 740 has a bore 730 for accepting the cylinder liner 710 and the flange 700. The cylinder block 740 has a bore notch 750 extending in an axial direction from the top of the block along the inside surface of the bore 730. The bore 730 is adapted to present a seating surface 760 for the flange 700. The flange 700 is recessed into the bore 730, such that, the top of the flange 700 is flush with the top of the cylinder block 740 and prevents movement in a lateral direction downward. To prevent rotation within the bore 730, a locking pin 770 is provided, such that, when the bore notch 750 and the flange notch 720 are aligned an aperture is defined that will accept the locking pin 770. The bore 730 and flange 700 are adapted to present a seating surface 789 so that the locking pin 770 is seated flush with tops of the block and flange. To prevent movement in a lateral direction upward, typically the bore and flange are covered by a valve plate, a gasket, or in the case of a compressor, a rear compressor cover.

The foregoing detailed description is merely illustrative of several physical embodiments of the invention. Physical variations of the invention, not fully described in the specification, may be encompassed within the purview of the claims. Accordingly, any narrower description of the elements in the specification should be used for general guidance, rather than to unduly restrict any broader descriptions of the elements in the following claims.

We claim:

1. A cylinder liner system, comprising:

a cylinder liner having an elongated tube, an inside surface, an outside surface, and a cylinder liner notch on a top side;

a block having a bore for concentrically accepting said cylinder liner; a locking pin that engages both said cylinder liner and said block;

wherein said cylinder liner further including grooves extending axially along said outside surface.

2. The cylinder liner system of claim 1 wherein said cylinder liner is cylindrical.

3. The cylinder liner system of claim 1 wherein said block further comprises a top surface and a block notch extending axially along an inside surface of said bore from said top surface of said block.

4. The cylinder liner system of claim 3 further comprising:

an annular flange having a top surface and a bottom surface, said annular flange being integrally connected to said cylinder liner;

said cylinder liner extending in the axial direction from said bottom surface of said annular flange;

a flange notch extending in an axial direction from said top surface of said annular flange to said bottom surface of said annular flange;

said bore being adapted to present a seating surface for said annular flange;

said flange notch and said block notch being adapted to present a seating surface for said locking pin;

wherein when said flange and said cylinder liner are inside said bore, said block notch and said flange notch define an aperture for accepting said locking pin for engaging said flange and said block.

5. The cylinder liner system of claim 1 wherein said cylinder liner is made of high wear resistance and low expansion cast iron.

6. The cylinder liner system of claim 1 wherein said block is made of aluminum alloy.

7. The cylinder liner system of claim 1 wherein said cylinder liner further comprises adhesive on said outside surface.

8. A cylinder liner system, comprising:

an annular flange having a top surface, a bottom surface and a cylinder liner member extending in the axial direction from said bottom surface of said annular flange;

said cylinder liner member comprising an elongated tube an inside surface, and a smooth outside surface;

a block having a bore for concentrically accepting said annular flange and said cylinder liner member; and said bore being adapted to present a seating surface for said annular flange wherein said block further including a top surface and a block notch extending axially along a inside surface of said bore from said top surface of said block.

9. The cylinder liner system of claim 8 wherein said cylinder liner is cylindrical.

10. The cylinder liner system of claim 8 wherein said cylinder liner is made of high wear resistance and low expansion cast iron.

11. The cylinder liner system of claim 8 wherein said block is made of aluminum alloy.

12. The cylinder liner system of claim 8 wherein said cylinder liner further comprises adhesive on said outside surface.

13. A method of producing a high pressure compressor cylinder liner, comprising:

providing a cylinder liner having an elongated tube, an inside surface, an outside surface, and a cylinder liner notch on a top side;

providing a block having a bore for concentrically accepting said cylinder liner;

providing a locking pin that engages said cylinder liner and said block wherein said cylinder liner further including grooves extending axially along said outside surface.

14. The method of claim 13 wherein said cylinder liner is cylindrical.

15. The method of claim 13 wherein said block further comprises a block notch extending axially along a inside surface of said bore.

16. The method of claim 13 further comprising:

providing an annular flange having a top surface and a bottom surface;

providing said cylinder liner extending in the axial direction from said bottom surface of said annular flange;

providing a flange notch extending in axial direction from said top surface to said bottom surface of said annular flange; and providing a seating surface for said annular flange in said bore; and wherein when said flange and said cylinder liner are inside said bore, said block notch and said flange notch define an aperture for accepting said locking pin for engaging said flange and said block.

17. The method of claim 13 wherein said cylinder liner is made of high wear resistance and low expansion cast iron.

18. The method of claim 13 wherein said block is made of aluminum alloy.

19. The method of claim 13 wherein said cylinder liner further comprises adhesive on said outside surface.

20. A method of producing a high pressure compressor cylinder liner, comprising:

providing an annular flange having a top surface, a bottom surface;

providing a cylinder liner member extending in the axial direction from said bottom surface of said annular flange;

said cylinder liner member having an elongated tube, an inside surface, and a smooth outside surface;

providing a block having a bore for concentrically accepting said annular flange and said cylinder liner member; and providing a seating surface for said annular flange in said bore wherein said cylinder liner further including grooves extending axially along said outside surface.

21. The method of claim 20 wherein said cylinder liner is cylindrical.

22. The method of claim 20 wherein said block further comprises a block notch extending axially along an inside surface of said bore.

23. The method of claim 20 wherein said cylinder liner is made of high wear resistance and low expansion cast iron.

24. The method of claim 20 wherein said block is made of aluminum alloy.

25. The cylinder liner system of claim 20 wherein said cylinder liner further comprises adhesive on said outside surface.

26. A cylinder liner system, comprising:

a cylinder liner having an elongated tube, an inside surface, an outside surface, and a cylinder liner notch on a top side;

a block having a bore for concentrically accepting said cylinder liner; and a locking pin that engages both said cylinder liner and said block;

wherein said cylinder liner further including a rough cast outside surface.

27. A cylinder liner system, comprising:

an annular flange having a top surface, a bottom surface and a cylinder liner member extending in the axial direction from said bottom surface of said annular flange;

said cylinder liner member having an elongated tube, a inside surface, and a smooth outside surface; a block having a bore for concentrically accepting said annular flange and said cylinder liner member;

said bore being adapted to present a seating surface for said annular flange;

wherein said cylinder liner further including grooves extending axially along said outside surface.

28. A cylinder liner system, comprising:

an annular flange having a top surface, a bottom surface and a cylinder liner member extending in the axial direction from said bottom surface of said annular flange;

said cylinder liner member having an elongated tube, a inside surface, and a smooth outside surface;

a block having a bore for concentrically accepting said annular flange and said cylinder liner member;

said bore being adapted to present a seating surface for said annular flange;

wherein said cylinder liner further including a rough cast outside surface.

29. A cylinder liner system, comprising:

an annular flange having a top surface, a bottom surface and a cylinder liner member extending in the axial direction from said bottom surface of said annular flange;

said cylinder liner member having an elongated tube, a inside surface, and a smooth outside surface;

a block having a bore for concentrically accepting said annular flange and said cylinder liner member;

said bore being adapted to present a seating surface for said annular flange;

said cylinder liner system further including:

a locking pin;

a flange notch extending in an axial direction from said top surface of said flange; and said flange notch and said block notch being adapted to present a seating surface for said locking pin;

wherein when said flange and said cylinder liner are inside said bore, said block notch and said flange notch define an aperture for accepting said locking pin for engaging said flange and said block.

30. A method of producing a high pressure compressor cylinder liner, comprising:

providing a cylinder liner having an elongated tube, an inside surface, an outside surface, and a cylinder liner notch on a top side;

providing a block having a bore for concentrically accepting said cylinder liner;

providing a locking pin that engages said cylinder liner and said block wherein said cylinder liner further including a rough cast outside surface.

31. A method of producing a high pressure compressor cylinder liner, comprising:

providing an annular flange having a top surface, a bottom surface;

providing a cylinder liner member extending in the axial direction from said bottom surface of said annular flange;

said cylinder liner member having an elongated tube, an inside surface, and a smooth outside surface;

providing a block having a bore for concentrically accepting said annular flange and said cylinder liner member; and providing a seating surface for said annular flange in said bore;

wherein said cylinder liner further including a rough cast outside surface.

32. A method of producing a high pressure compressor cylinder liner, comprising:

providing an annular flange having a top surface, a bottom surface;

providing a cylinder liner member extending in the axial direction from said bottom surface of said annular flange;

said cylinder liner member having an elongated tube, an inside surface, and a smooth outside surface;

providing a block having a bore for concentrically accepting said annular flange and said cylinder liner member; and providing a seating surface for said annular flange in said bore;

said method further including:

providing a locking pin;

providing a flange notch extending axially along said flange;

said flange notch and said block notch being adapted to provide a seating surface for said locking pin; and wherein when said flange and said cylinder liner are inside said bore, and said block notch and said flange notch define an aperture for accepting said locking pin for engaging said flange and said block.

* * * * *